US006895975B2

(12) United States Patent
Hafemann

(10) Patent No.: US 6,895,975 B2
(45) Date of Patent: May 24, 2005

(54) HOT AIR HAIR STYLING DEVICE ATTACHMENT

(75) Inventor: Klaus Hafemann, Essen (DE)

(73) Assignee: Wik Far East Ltd., Hong Kong (CN)

( * ) Notice: Subject to any disclaimer, the term of this patent is extended or adjusted under 35 U.S.C. 154(b) by 73 days.

(21) Appl. No.: 10/350,689

(22) Filed: Jan. 24, 2003

(65) Prior Publication Data

US 2003/0145871 A1 Aug. 7, 2003

(30) Foreign Application Priority Data

Jan. 24, 2002 (DE) ..... 202 00 971 U

(51) Int. Cl.[7] ..... A45D 6/06; A45D 19/16; A45D 1/00

(52) U.S. Cl. ..... 132/228; 132/272; 132/224

(58) Field of Search ..... 34/96, 97, 98; 261/DIG. 76; 132/228, 271, 229, 225, 224, 227, 118; 219/222–226

(56) References Cited

U.S. PATENT DOCUMENTS 4,533,819 A * 8/1985 Valiulis ..... 219/225
5,223,694 A * 6/1993 Tsuji et al. ..... 219/225
5,357,988 A * 10/1994 Nakamura ..... 132/232
5,400,809 A 3/1995 Adams
6,138,376 A * 10/2000 Garfinkel ..... 34/283
6,363,215 B1 * 3/2002 Cafaro ..... 392/384
6,601,316 B2 * 8/2003 Shaw, II ..... 34/98

FOREIGN PATENT DOCUMENTS

| | | |
|---|---|---|
| DE | 29 22 396 | 12/1980 |
| FR | N73 31635 | 3/1975 |
| WO | PCT/US93/10830 | 5/1995 |

* cited by examiner

*Primary Examiner*—John J. Wilson
*Assistant Examiner*—Robyn Doan
(74) *Attorney, Agent, or Firm*—Margaret Polson; Patent Law Offices of Rick Martin, P.C.

(57) ABSTRACT

An integrated hot air hair styling device with a hair care segment or a hair care segment attachable to a hair dryer is disclosed. The hair care segment has the following sections: Two articulated arms having substantially complementary facing surfaces forming a first hair styling gap. A flow channel for conducting the air stream from the hot air blower to the hair care segment and into at least one of the arms. Air escape openings connected with flow channel(s) in the arm(s). A curved outer surface on an arm with air escape openings. A hair styling finger with a complementarily curved surface is pivotably mounted to the arm with the curved surface, and extends longitudinally with this arm, forming a second hair styling gap between this arm and the hair styling finger. A brush attachment can be placed over both of arms, with air escape openings between its bristles.

14 Claims, 1 Drawing Sheet

HOT AIR HAIR STYLING DEVICE ATTACHMENT

CROSS REFERENCE APPLICATIONS

This application claims priority from German application no. 202 00 971.8 filed Jan. 24, 2002.

FIELD OF INVENTION

The present invention relates to a hot air hair styling device with a hot air blower and a hair care segment upon which acts an air stream generated by the hot air blower. The invention further relates to a hair care segment, which is developed as an attachment for a hot air blower.

BACKGROUND OF THE INVENTION

Hot air hair styling devices which are developed as curling rods, as hair straighteners or as air brushes are well known in the art. Hot air hair styling devices are in each case designed for different, individual hair styling purposes. In order to style hair using such devices, a user must have available all three devices. This means that the user must have sufficient space and a sufficient number of electrical connections available in order to be able to shape the hair in the desired manner with these, and possibly further, hair care devices.

The invention therefore addresses the problem of designing a hot air hair styling device with a hair care segment such that several hair styling functions can be performed with the same hair care segment. The hair care segment can be developed as an attachment for a hot air blower or as single integrated part of the device.

SUMMARY OF THE INVENTION

The primary aspect of the present invention is to provide a hair styling device which can perform several types of hair styling functions.

Other aspects of this invention will appear from the following description and appended claims, reference being made to the accompanying drawings forming a part of this specification wherein like reference characters designate corresponding parts in the several views.

The present invention is an integrated hot air hair styling device with a hair care segment or a hair care segment developed as an attachment for a hot air blower. The hair care segment has the following sections:

- two articulated arms, each arm having the facing surfaces which are substantially complementary, forming a first hair styling gap,
- at least one flow channel for conducting the air stream provided by the hot air blower within the hair care segment and in at least one of the two arms,
- air escape openings connected with flow channel(s) in the arm(s) with the flow channel,
- a curved outer surface on an arm with air escape openings, with which curved surface is associated a hair styling finger developed with a curvature complementary to this surface, supported pivotably relative to this arm and extending in the longitudinal direction of this arm, such that between this arm and the hair styling finger a second hair styling gap is formed, and
- a brush attachment, which can be placed onto both of the arms, with air escape openings disposed between its bristles or tufts of bristles.

The hair care segment can be either a part of a hot air hair styling device or an attachment for a hot air blower (hair dryer). The hair care segment has two arms articulated with one another in the manner of scissors. Between the two arms is a first hair styling gap, wherein the styling of the hair held between the two arms by to the surface shape of the sides facing one another of the arms is possible. The heat required for the hair shaping is provided by a hot air blower, whose air stream enters into at least one flow channel of the hair care segment and escapes from air escape openings of at least one of the two arms in order to reach the hair placed in the first hair styling gap. Both arms can be hollow and therefor have a flow channel and air escape openings. With such an implementation heating from both sides takes place of the hair placed in the first hair styling gap. In case the surfaces facing one another of the two arms are flat or substantially flat, the first hair styling gap can be utilized as a hair straightener. Due to the pivotable disposition of the one arm relative to the other arm, hair can readily be placed into the first hair styling gap and again be removed from it.

At least one of the two arms has a sectionally curved outer surface, generally the outer surface opposite the other arm, or top surface. Associated with this curved surface is a hair styling finger pivotably attached to this arm, whose longitudinal extension follows the longitudinal direction of this arm. The surface of the hair styling finger facing toward the arm is developed complementarily to the curved surface of the arm. Consequently, a second hair styling gap is formed between the arm and the hair styling finger. Due to the pivotable disposition of the hair styling finger and the curvature of the arm and the hair styling finger, hair can be placed into the hair styling gap and be shaped under the simultaneous supply of hot air. The hair styling finger has an actuation lever with which the second hair styling gap can be opened against the force of a spring element. In this manner the hair care segment can be utilized as a curling rod.

A further component of the hair care segment is a brush attachment, which can be placed over both arms jointly and enclose both arms. It is useful if the hair styling finger is also enclosed by the brush attachment. The brush attachment has air escape openings between its bristles or bristles tufts, such that hot air escaping from the air escape openings can also escape between the bristles or bristle tufts and can reach the hair to be styled. In this implementation the hair care segment can be utilized as an air brush or an air curler.

Using the present invention the hair styling which previously required several individual device can be realized with a single device. Through this hair care segment the styling of hair is not only simplified with respect to the number devices, but hair styling can also be done more rapidly since a device change is no longer necessary.

It is useful if such a hair care segment is developed such that one of the two arms comprises a tubular connection piece into which flows the hot air provided by the hot air blower. When the hair care segment is developed as an attachment, the connection piece serves simultaneously as a coupling piece with which the hair care segment can be placed on a hot air blower, which can be developed as a handle piece. In this case the connection piece generally has a latching means, for example a bayonet latch, for securing the hair care segment in place on the handle piece.

To open and close the hair styling finger disposed between the two arms serves an actuation lever, usefully developed in the form of a bow, which is a portion of the other arm pivotably articulated on the one arm. The actuation lever extends preferably up to that side of the hair care segment on which is provided an actuation lever associated on the hair care finger for opening the second hair styling gap. Consequently both scissor-like elements of the hair care segment can be actuated, for example with the thumb, from the same side. An implementation is useful in which the actuation lever for opening and closing of the hair styling gap between the two arms can be secured in position on the other arm or on another element stationary with respect to it, for example by a latch.

The brush attachment can be an open cylindrical annular body, on which the bristles or bristle tufts are disposed such that they project radially outwardly. This annular body is usefully comprised of an elastic material such that the placement of the brush attachment onto the two arms is easy and sufficiently tight seating is ensured for operating the hair care segment as an air brush or an air curler. To prevent rotation between the brush attachment and the remaining components of the hair care segment the hair styling finger can serve as a locking groove and engage a corresponding groove of the brush attachment.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
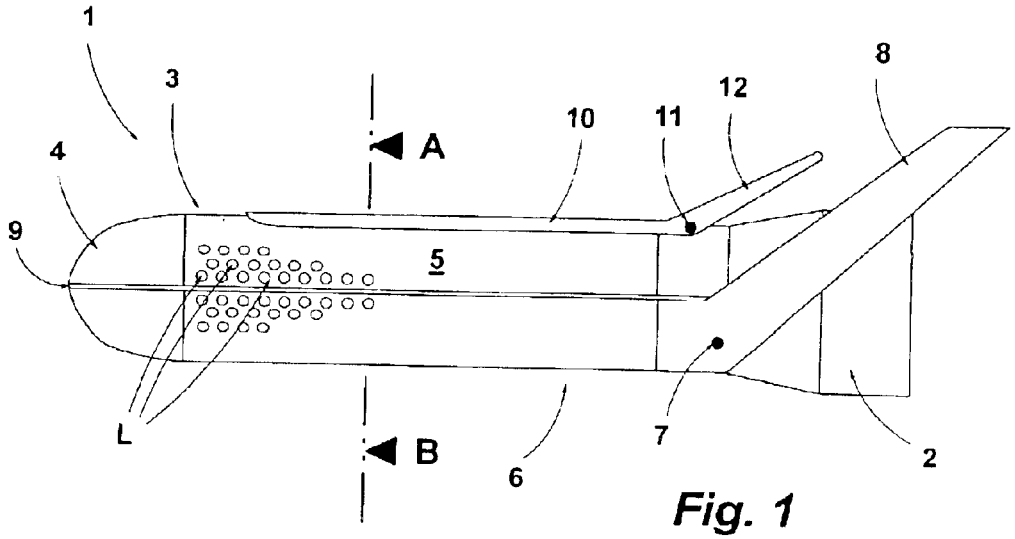
FIG. 1 is a schematic side view of a hair care segment developed as an attachment for a hot air blower.

As shown in FIG. 1, a hair care segment 1 is developed as an attachment, which is placed onto a hot air blower integrated into a handle piece (not shown). The hair care segment has a tubular connection piece 2, with which the hair care segment 1 can be attached onto such a handle piece. The connection piece 2 has a first arm 3 extending from it. The arm 3 comprises a tip 4 rounded-off at the front and a middle segment 5 with air escape openings L. The arm 3 is generally hollow, forming a flow channel together with the connection piece 2. Therefore, the air stream provided by the hot air blower enters the connection piece 2 and arm 3 and escapes through air escape openings L. In the figures only a small region of segment 5 with air escape openings L is marked; the air escape openings L can extend circumferentially over the entire segment 5 or any portion thereof.

A second arm 6 is pivotably mounted on the connection piece 2 on pivot axis 7. The arm 6 is basically structured like arm 3 and thus also hollow, with the hollow volume of arm 6 also forming a flow channel into which, in the position of arm 6 depicted in FIG. 1, flows proportionately an air stream from connection piece 2. Due to the pivotable disposition of the second arm 6 relative to the first arm 3, the two arms 3, 6 can be moved relative to one another like scissors. For this purpose the second arm 6 has a bow-like actuation lever 8, which extends bilaterally on the outside of the connection piece 2 and over the connection piece 2, forming bow or U over connection piece 2 and can be moved by the user as shown by arrow w.

Figure 2:
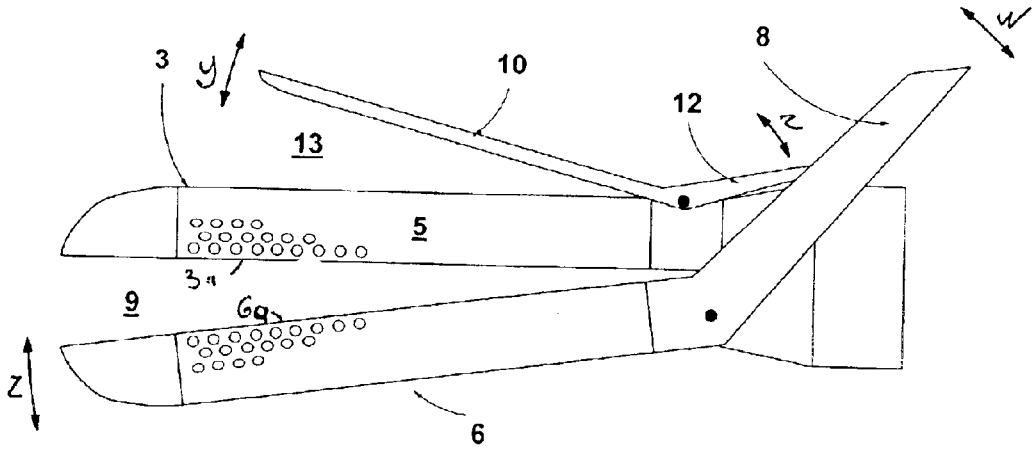
FIG. 2 is a representation of FIG. 1 with the hair styling gaps open.
Figure 3:
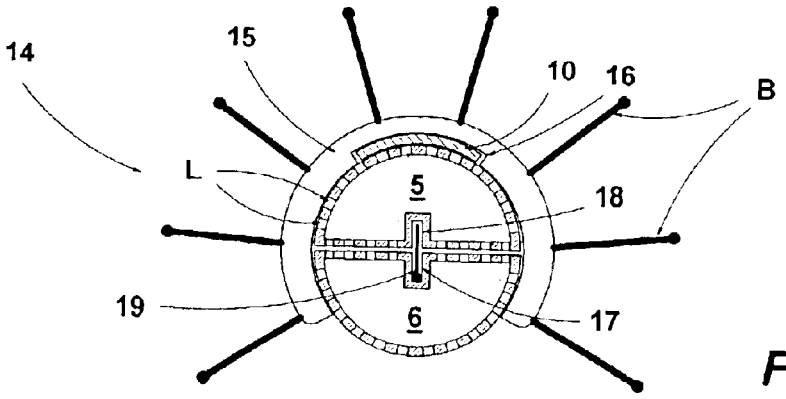
FIG. 3 is a cross section through the hair care segment of FIG. 1 along line A–B.

In FIG. 1 the second arm 6 is closed and is latched closed to the connection piece 2 by means not shown. A spring element (not shown) bias arm 6 to the open position, such that, upon the opening of the latch, the arm 6 swivels open as shown in FIG. 2 by arrow z. Between the two arms 3, 6 a first hair styling gap 9 is developed. In the open scissor position of the two arms 3, 6, as shown in FIG. 2, hair can be placed into the hair styling gap 9. In one embodiment the two sides 3*a*, 6*a* of arms 3, 6 facing toward one another are developed substantially flat, as can be seen in FIG. 3, such that hair placed into the hair styling gap 9 can be straightened.

The surfaces facing one another of the two arms 3, 6 can also have a textured surface(not shown). For example they can be developed in the form of waves, such that hair can be crimped in the first hair styling gap. The textured surface can also be developed in the manner of a volumizer.

Associated with arm 3 is a hair styling finger 10, whose surface facing toward arm 3 is complementarily shaped to the curved outside of arm 5. This configuration is also shown in particular in FIG. 3. The hair styling finger 10, like the second arm 6, is pivotably mounted on the continuous unit formed by the first arm 3 and the connection piece 2 at pivot axis 11.

The hair styling finger 10 has an actuation lever 12, which is pivotable against the force of a spring element, not shown in the Figures. The hair styling finger 10 and the actuation lever 12 move as shown by arrows y and z in FIG. 2 so that by moving the actuation lever 12 a second hair styling gap 13 is formed between the upper side of the first arm 3 and the hair styling finger 10. Due to the curved surface of the first arm 3 and the corresponding complementary curve of the hair styling finger 10, the second hair styling gap 13 can be use for forming individual curls.

A further part of the hair care segment 1 is a brush attachment 14 shown cross section in FIG. 3. The brush attachment 14 comprises a cylindrical open annular body 15, with individual bristles B disposed such that they project radially outwardly. The material of annular body 15 is elastic and held with a certain pretension in its mounted position shown in FIG. 3 on both arms 3, 6.

In the depicted embodiment example a groove 16 placed into the inner surface of annular body 15, into which extends the hair styling finger 10, serves as a protection against rotation of the brush attachment 14. Between the individual bristles B, or the individual bristle segments, air escape openings are provided in the annular body 15, such that the air escaping from the air escape openings L of arms 3, 6 can move through the annular body 15 and reach the hair. A further implementation provides that the brush attachment comprises a closed cylindrical annular body (not shown), on which the bristles or tufts of bristles are disposed such that they project radially outwardly. This brush attachment is slid onto both closed arms 3, 6 of the hair care segment 1.

Each of the surfaces 3*a*, 6*a* directed toward one another of arms 3, 6 of the depicted embodiment example can have a groove 17 or 18, into which can be set a comb spine 19. The comb spine 19 is held in the depicted embodiment example in groove 17 of arm 6, while the individual teeth of the comb spine 19 extend into the groove 18 of the first arm 3. The insertion of such a comb spine 19 during the straightening of hair serves for guiding the same such that when straightening the hair it can simultaneously be combed.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

LIST OF REFERENCE SYMBOLS

1 Hair care segment
2 Connection piece
3 Arm
3*a* Facing surface
4 Tip
5 Segment
6 Arm
6*a* Facing surface
7 Pivot axis
8 Actuation lever
9 Hair styling gap
10 Hair styling finger
11 Pivot axis
12 Actuation lever
13 Hair styling gap
14 Brush attachment
15 Annular body
16 Groove
17 Groove
18 Groove
19 Comb spine
B Bristle
L Air escape opening

I claim:

1. A hot air hair styling device with a hot air blower within a handle section and a hair care segment attached to the handle section upon which acts an air stream generated by the hot air blower, said hair care segment comprising:

a first and a second articulated arm having substantially complementary facing surfaces forming a first hair styling gap between said facing surfaces;

at least one air flow channel formed within the hair care segment and at least one of the articulated arms for conducting the air stream from the hot air blower through the hair care segment;

a plurality of air escape openings extending from the air flow channel to an outer surface of the articulated arm;

a portion of the air escape openings being in the facing surfaces of the first and second articulated arms forming the first hair styling gap;

at least one of the articulated arms having a curved outer surface with some air escape openings in the curved outer surface; and a hair styling finger having a curvature complementary to the curved outer surface and being pivotably supported relative to the articulated arm and extending in a longitudinal direction of the articulated arm, such that between the arm and the hair styling finger a second hair styling gap is formed.

2. A hair care segment developed as an removable attachment for a hot air blower, said hair care segment comprising:

a first and a second articulated arm having substantially complementary facing surfaces forming a first hair styling gap betwen said facing surfaces;

at least one air flow channel formed within the hair care segment and at least one of the articulated arms for conducting a air stream from the hot air blower through the hair care segment;

a plurality of air escape openings extending from the air flow channel to an outer surface of the articulated arm;

a portion of the air escape openings being in the facing surfaces of the first and second articulate arms forming the first hair styling gap;

at least one of the articulated arms having a curved outer surface with some air escape openings in the carved outer surface; and a hair styling finger having a curvature complementary to the curved outer surface and being pivotably supported relative to the articulated arm and extending in a longitudinal direction of the articulated arm, such that between the arm and the hair styling finger a second hair styling gap is formed.

3. The hair care segment as claimed in claim 1 or 2, wherein the facing surfaces of the articulated arms are substantially flat.

4. The hair care segment as claimed in claim 3, wherein one articulated arm further comprises in the facing surface a groove for receiving a comb spine and the facing surface of the other articulated arm a groove for receiving comb teeth.

5. The hair care segment as claimed in one of claim 1 or 2, wherein one arm of the hair care segment is a contiguous unit with a tubular connection piece for receiving the air stream and the hair styling finger and the other arm are pivotably articulated on this contiguous unit comprised of arm and connection piece.

6. The hair care segment as claimed in claim 3, wherein one arm of the hair care segment is a contiguous unit with a tubular connection piece for receiving the air steam and the hair styling finger and the other arm arc pivotably articulated on this contiguous unit comprised of arm and connection piece.

7. The hair care segment as claimed in claim 4, wherein the first arm of the hair care segment is a contiguous unit with a tubular connection piece for receiving the air stream and the hair styling finger and the second arm are pivotably articulated on this contiguous unit comprised of arm and connection piece.

8. The hair care segment as claimed in claim 5, wherein the second arm further comprises a bow-shaped actuation lever extending toward the location on the first arm on where the hair styling finger is pivotably articulated.

9. The hair care segment as claimed in claim 8, wherein the actuation lever can be latched for closing the first hair styling gap.

10. The hair care segment as claimed in one of claim 1 to 2, wherein the hair styling finger further comprises an actuation lever for opening the second hair styling gap against the force of a spring element.

11. The hair care segment as claimed in one of claim 1 or 2 further comprising:

a brush attachment which can be placed over both articulated arms; and said brush attachment having air escape openings disposed between bristles on an outer surface of the brush attachment.

12. The hair care segment as claimed in claim 11, wherein the brush attachment comprises an open cylindrical annular body on which are disposed the bristles and whose interior is shaped to receive the two closed arms and the closed hair styling finger.

13. The hair care segment as claimed in claim 12, wherein the open annular body comprises a material having elastic properties, thereby ensuring a sufficiently secure seating of the brush attachment on the two closed arms end the hair styling finger.

14. The hair care segment as claimed in claim 11, wherein the brush attachment comprises a closed cylindrical annular body on which are disposed the bristles and whose interior is shaped to receive the two closed arms and the closed hair styling finger.

* * * * *